United States Patent [19]

Lee

[11] 4,279,298

[45] Jul. 21, 1981

[54] HEAT EXCHANGER WITH CONDENSATE BLOW-OFF SUPPRESSOR

[75] Inventor: Yong N. Lee, Arlington Heights, Ill.

[73] Assignee: Borg-Warner Corporation, Chicago, Ill.

[21] Appl. No.: 131,124

[22] Filed: Mar. 17, 1980

[51] Int. Cl.[3] ..... F25D 21/14; F28F 1/14

[52] U.S. Cl. ..... 165/181; 165/DIG. 18; 62/290

[58] Field of Search ..... 165/111–182, 165/DIG. 18, 290; 62/285, 286, 292, 288, 290, 103, 272

[56] References Cited

U.S. PATENT DOCUMENTS

| | | | |
|---|---|---|---|
| 1,907,036 | 5/1933 | Belleau | 165/182 |
| 2,046,968 | 7/1936 | Raisley | 62/285 |
| 2,133,354 | 10/1938 | Krackowizer | 165/135 X |
| 2,804,286 | 8/1957 | Pintarelli | 165/182 |
| 3,750,418 | 8/1973 | Maudlin | 62/285 X |
| 4,041,727 | 8/1977 | Maudlin | 62/290 |

FOREIGN PATENT DOCUMENTS

| | | | |
|---|---|---|---|
| 1023474 | 1/1958 | Fed. Rep. of Germany | 165/182 |

*Primary Examiner*—Samuel Scott
*Assistant Examiner*—Theophil W. Streule, Jr.
*Attorney, Agent, or Firm*—Thomas B. Hunter

[57] ABSTRACT

A heat exchanger having a flow of air therethrough adapted for use in refrigeration systems includes a heat exchange coil and a plurality of sheet-like fins. The coil is formed of a plurality of tubes having a cooling medium flowing therethrough. Each of the fins are provided with openings for receiving the tubes in heat transfer relationship. A plurality of tabs are arranged in a surrounding relationship around the lower portion of the openings on the tubes for preventing the blow-off of condensate drops forming on the underneath side of the tubes.

3 Claims, 8 Drawing Figures fig.1.
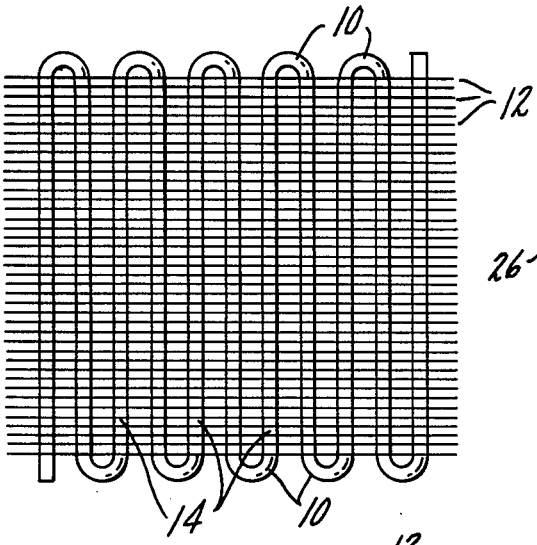
fig.2.
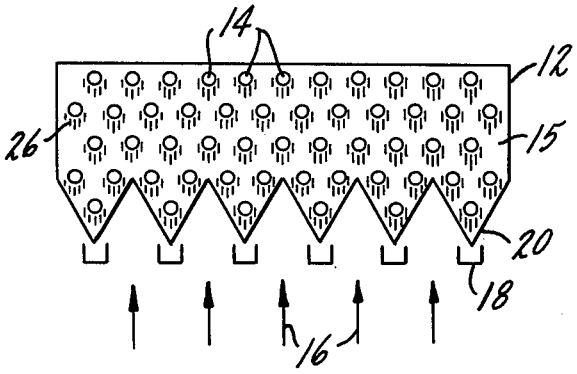
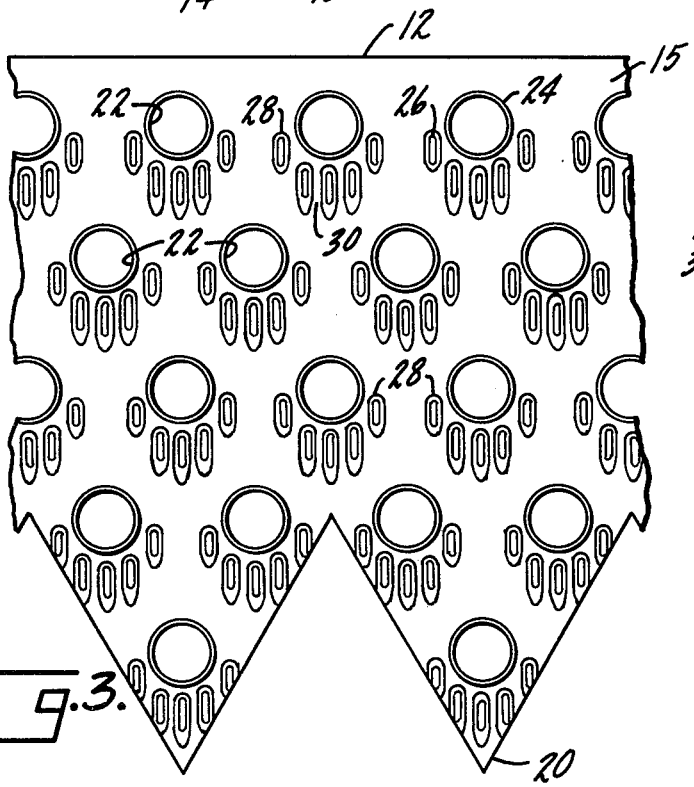
fig.3.
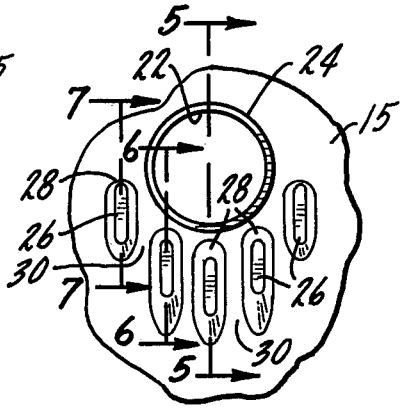
fig.4.
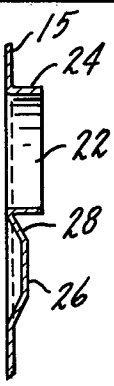
fig.5.
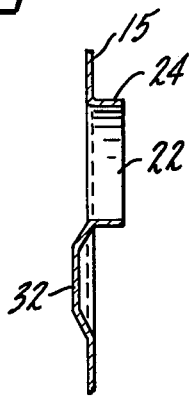
fig.8.
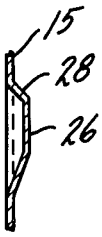
fig.6.
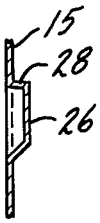
fig.7.

HEAT EXCHANGER WITH CONDENSATE BLOW-OFF SUPPRESSOR

BACKGROUND OF THE INVENTION

1. Field of the Invention

This invention relates generally to heat exchangers and more particularly, it relates to a wet tube-in-fin, flat-top evaporator coil of the type in which a stream of air to be cooled is forced across the finned surfaces in a vertical air flow.

2. Description of the Prior Art

In U.S. Pat. No. 2,046,968 issued to J. C. Raisley on July 7, 1936, there is shown a plurality of fins threaded on the tubes of a refrigerant coil. Each of the fins are formed with a series of indentations on both sides and are alternately arranged to form pockets adapted for the collection and retention of drops of condensed moisture.

In U.S. Pat. No. 2,099,665 issued to R. T. Smith on Nov. 16, 1937, there is shown a refrigerating coil with which is associated a series of substantially parallel fins mounted in vertical planes. The adjacent fins of the series are spaced apart at a given distance for effective drainage of water droplets.

In U.S. Pat. No. 3,223,153 issued to C. S. Simpelaar on Dec. 14, 1965, there is shown a heat exchanger structure wherein a sinuous continuous metal sheet having a parallel series of aligned slots are folded in order to produce adjacent pleats constituting the spaced fins.

In U.S. Pat. No. 3,759,050 issued to R. S. Slaasted et al. on Sept. 18, 1973, there is disclosed a method of cooling a gas and removing moisture therefrom which includes a plurality of spaced louvers on the fins immediately above the tubes for providing liquid flow paths of liquid condensate along the tubes onto the tubes and from there down the tubes.

In U.S. Pat. No. 3,902,551 issued to A. T. Lim et al. on Sept. 2, 1975, there is disclosed a plate fin type heat exchanger construction in which the fin members are formed with longitudinal corrugations for removing condensate droplets by gravity flow to a drain pan.

In U.S. Pat. No. 3,923,098 issued to R. A. Ares on Dec. 2, 1975, there is disclosed a heat exchanger having at least one condensate channel of a U-shaped configuration disposed in the downstream edge of each of the fins for collection and drainage of the condensate.

Heretofore, it has been generally known that condensate droplets accumulate on the underneath side of evaporator coils. As the droplets of water increases in size due to its unstable condition in a varying static pressure field, the large main drops of water will changes its shape to satisfy its equilibrium condition in which the main drops possess a bulged part. The bulged parts will disintegrate from the main drops causing a blow-off and are entrained for a distance by the vertical airstream flow into the conditioned air. This results in the undesired conditions of water droplets entrained into the duct system, excessive pressure drop through the evaporator coil and decreasing the heat transfer coefficient of the finned surfaces, thereby reducing significantly the capacity of the evaporator coils.

It would be, therefore, desirable to provide a means for controlling the blow-off of water droplets from the surface of the evaporator tubes by transforming the large unstable drops into a plurality of small droplets so as to increase its stability. Consequently, the critical face velocity at which blow-off occurs can be increased significantly. Since the capacity of the evaporator coils increase with face velocity, the heat transfer characteristic of the evaporator coils is also greatly improved in performance and yet without increasing the pressure drop. This improved operation is accomplished by providing a plurality of sheet-like fins having a series of openings for receiving the evaporator tubes and a number of tabs disposed vertically and directly below the openings for contacting the condensate hanging underneath the tubes.

SUMMARY OF THE INVENTION

Accordingly, it is a general object of the present invention to provide a new and improved heat exchanger having means for preventing condensate blow-off.

It is another object of the present invention to provide a means for controlling the blow-off of water droplets from the surface of evaporator tubes by transforming the large unstable drops into a plurality of small droplets so as to increase their stability.

It is another object of the present invention to provide a heat exchanger having a plurality of sheet-like fins with a series of openings for receiving the tubes and a number of tabs disposed vertically and directly below the openings for contacting the condensate hanging underneath the tubes.

It is still another object of the present invention to provide a heat exchanger having means for preventing condensate blow-off which is relatively simple in construction and easy to manufacture and assemble.

BRIEF DESCRIPTION OF THE DRAWINGS

These and other objects of the present invention will become more fully apparent from the following detailed description when read in conjunction with the accompanying drawings wherein:

FIG. 1 is a top plan elevational view of a heat exchanger constructed in accordance with the principles of the present invention;

FIG. 2 is a side cross-sectional view of sheet-like fin according to the present invention;

FIG. 3 is an exploded fragmentary view of the sheet-like fin shown in FIG. 2;

FIG. 4 is an exploded fragmentary view of a tube opening and the surrounding tabs constructed in accordance with the principles of the present invention;

FIGS. 5–7 are vertical section views taken along the respective lines 5—5, 6—6, and 7—7 of FIG. 4 looking in the direction of the arrows; and FIG. 8 is a vertical sectional view, showing another embodiment of the present invention.

DESCRIPTION OF THE PREFERRED EMBODIMENT

Referring now to the drawings, there is illustrated in FIG. 1 a heat exchanger constructed in accordance with the principles of the present invention. This heat exchanger has particular applications as an evaporator for refrigeration systems. The heat exchanger coil consists of U-bends 10 and tubes 14 with which is associated a plurality of closely and substantially equally spaced, parallel sheet-like fins 12 disposed in a horizontal plane. The sheet-like fins 12 are connected on the tubes 14 and are formed preferably of thin sheet metal. As can be seen in FIG. 2, the fin 12 is preferably formed of a sawtooth-shaped construction, and each of the tubes 14 are adapted for circulating a cooling medium therewithin. A blower (not shown) may be utilized to direct a stream of the air to be conditioned upwardly in a vertical airflow pattern across the surfaces 15 of the fins 12 in the direction of the arrows 16. Suitable condensate collecting means such as pans or troughs 18 are provided to collect condensate from the surfaces of the fins 12. The condensate troughs 18 are disposed beneath each of the sawtooth-portion 20 of the fins 12 and extend substantially longitudinal along the tubes 14.

As may be seen more clearly from the exploded fragmentary views of FIGS. 3 and 4, each of the fins 12 include a series of openings 22 for receiving the tubes 14. Each opening 22 is surrounded by an annular flange 24 which is struck from the sheet metal for operating as spacer means for the adjacent fins 12. Each of the openings 22 are also provided with suppressor means such as a plurality of tabs or projections 26. The tabs are arranged vertically in a surrounding relationship around the lower portion of the openings 22. The top portions or ends 28 of the tabs 26 are positioned adjacent the underneath side of the openings 22 so as to be sufficiently close to the tubes 14 when assembled for contacting the condensate drops or blobs formed on the bottom surfaces of the tubes. Further, adjacent tabs form channels 30 therebetween for draining the condensate drops under the influence of gravity to the troughs 18. While there has only been five tabs shown in association with each opening in this embodiment of the invention, it will be appreciated by those skilled in the art that the exact number and location of the tabs to be employed will be determined by the design requirements of the heat exchanger, i.e., the extent of dehumidification and cooling to be desired.

FIGS. 5, 6 and 7 depict the tab configurations in a cross-sectional view. The top portion 28 of the tab 26 in FIG. 5 of the drawings is formed as an integral part of the annular flange 24. One alternate embodiment to the tab construction is shown in FIG. 8 of the drawings. This is a cross-sectional view illustrating an indentation 32 formed in the fins in lieu of the tabs for draining the condensate drops.

In operation of the heat exchanger in a refrigeration system, liquid refrigerant is passed through the tubes 14 which evaporates and cools the air drawn through the fins 14. As a result, any moisture carried by the air will be condensed upon the surfaces of the tubes. This condensation produces large main drops of water which tend to adhere to the underneath side of the tubes. Since these large drops are in an unstable condition, they will change its shape to satisfy their equilibrium condition in which the main drops possess a bulged part. The bulged parts will eventually disintegrate from the main drops, thereby causing condensate blow-off into the conditioned air by the air stream as indicated by the arrows 16.

In order to prevent or minimize the blow-off, the large unstable drops are initially transported away from the tube to a region where the air velocity is lower. Then, the large blobs of water are transformed into a number of small stable droplets which are more able to resist against being torn off than the larger drops. This is accomplished by the tabs 26 which are arranged around the lower portion of the tube openings 22 for intercepting the condensate forming on the underneath side of the tubes and for directing such condensate by gravity flow along the channels 30 formed by the tabs. When the blobs of water contact the top ends or tips of the tabs, they will be drawn under the influence of a capillary action into the channels 30. At the end of these channels, where the air velocity is lower than near the tubes, the condensate forms the plurality of small, stable rivulets which continues to flow downwardly between the other tubes and along the surface 15 of the fins to the bottom sawtooth portion or edge 20 for collection by the troughs 18.

From the foregoing detailed description it can thus be seen that the present invention provides a new and improved heat exchanger with condensate blow-off supressor which includes a plurality of tabs for contacting the condensate hanging on the underneath side of the tubes. As a result of the present invention, the critical face velocity can be increased substantially to 750 ft/min or higher as opposed to about 450 ft/min without the suppressor. Further, since the capacity of a heat exchanger increases with face velocity the heat transfer performance is also improved without any abnormal increase in pressure drop.

While there has been illustrated and described what is at present to be a preferred embodiment of the present invention, it will be understood by those skilled in the art that there various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention but that the invention will include all embodiments falling within the scope of the appended claims.

What is claimed is:

1. A fin and coil type evaporator assembly positionable in a vertically, upwardly flowing air stream comprising: an evaporator coil including a plurality tube sections extending transversely to the direction of air flow; a plurality of plate-like fins closely spaced apart, each fin lying in a plane parallel to the direction of air flow and being in heat exchange contact with said tube sections which pass through said fins; and means defining a plurality of channels, elongated in the direction of air flow and located closely adjacent to said tube sections only on the up-stream side thereof, said channels being adapted to break up and draw off, by capillary action, large droplets of water condensing on said tube sections and adhering to the underside thereof, whereby blow-off of condensate from the tubes is minimized.

2. An evaporator assembly as defined in claim 1 wherein said channels are formed by a series of projections extending outwardly from the plane of each fin.

3. An evaporator assembly as defined in claim 2 wherein the lower edge of each said fin is formed with a sawtooth configuration to promote removal of the condensate.

* * * * *